US010123618B2

(12) United States Patent
Lei et al.

(10) Patent No.: US 10,123,618 B2
(45) Date of Patent: Nov. 13, 2018

(54) HOUSEHOLD APPLIANCE

(71) Applicant: BSH HAUSGERAETE GMBH, Munich (DE)

(72) Inventors: Wuba Lei, Chuzhou (CN); Ran Sun, Nanjing (CN); Xiaoli Wang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/611,828

(22) Filed: Jun. 2, 2017

(65) Prior Publication Data

US 2017/0354252 A1 Dec. 14, 2017

(30) Foreign Application Priority Data

Jun. 13, 2016 (CN) ..... 2016 1 0422018

(51) Int. Cl.
*A47B 96/04* (2006.01)
*F25D 23/00* (2006.01)

(52) U.S. Cl.
CPC ..... *A47B 96/04* (2013.01); *F25D 23/00* (2013.01)

(58) Field of Classification Search
CPC ..... A47B 96/04; F25D 23/00; F25D 23/069; F25D 23/065; F25D 25/02; F25D 25/024
See application file for complete search history.

(56) References Cited

U.S. PATENT DOCUMENTS 3,872,688 A * 3/1975 Tillman ..... F25D 23/069 62/291
4,067,628 A * 1/1978 Sherburn ..... F25D 23/064 220/592.05
4,191,434 A * 3/1980 Powell ..... F25D 23/069 312/407
4,771,532 A * 9/1988 Taylor, Jr. ..... B29C 44/3411 220/592.1
6,460,955 B1 * 10/2002 Vaughan ..... B29C 51/267 312/236
6,471,080 B1 * 10/2002 Hoffmann ..... A47B 63/00 211/126.1
2007/0228907 A1 * 10/2007 Luisi ..... F25D 23/069 312/404
2009/0013710 A1 * 1/2009 Cho ..... F25D 23/062 62/285
2013/0313958 A1 * 11/2013 Moon ..... F25D 23/04 312/404
2014/0015394 A1 * 1/2014 Cha ..... B23P 15/26 312/404

* cited by examiner

*Primary Examiner* — Hanh V Tran
(74) *Attorney, Agent, or Firm* — Laurence A. Greenberg; Werner H. Stemer; Ralph E. Locher

(57) ABSTRACT

A household appliance includes a storage space. A partition plate located in the storage space includes a first surface, a second surface, a first end, and a second end. A first connecting structure includes a first projecting portion and a first slot. The first slot includes a first slot section and a second slot section being in communication with the first slot section and extending in a front-back direction. The first slot section has an inlet opening to the first surface and/or the second surface. The first projecting portion is adapted to enter the first slot section through the inlet and then enter the second slot section. The household appliance is therefore easy to assemble.

10 Claims, 5 Drawing Sheets

HOUSEHOLD APPLIANCE

CROSS-REFERENCE TO RELATED APPLICATION

This application claims the priority, under 35 U.S.C. § 119, of Chinese Patent Application CN 2016 1042 2018.X, filed Jun. 13, 2016; the prior application is herewith incorporated by reference in its entirety.

BACKGROUND OF THE INVENTION

Field of the Invention

The present invention relates to the technical field of household appliances.

Currently, some household appliances have storage space, which can be used to store objects. Generally, a partition plate is disposed in the storage space. The partition plate can partition the storage space into at least two spaces, and the partitioned spaces can be used to store different objects.

In a prior art appliance, the partition plate is fixed on an inner wall of the storage space by using an external connecting piece. The assembly structure is complex, the assembly process is difficult to operate and use of the external connecting piece also increases costs.

On the other hand, when a middle partition beam is disposed at a front opening of the storage space, the partition plate generally needs to be installed in a box body, and then the middle partition beam is installed.

SUMMARY OF THE INVENTION

It is accordingly an object of the invention to provide a household appliance, which overcomes the hereinaforementioned disadvantages of the heretofore-known appliances of this general type and which can be easily assembled to solve at least one technical problem that exists in the prior art.

With the foregoing and other objects in view there is provided, in accordance with the invention, a household appliance, comprising a storage space having a front opening, a rear wall and first and second walls disposed opposite each other, a partition plate located in the storage space to partition the storage space at least into a first space and a second space, the partition plate having a first surface facing the first space, a second surface facing the second space, a first end facing the first wall and a second end facing the second wall, and a first connecting structure configured to connect the partition plate and the first wall, the first connecting structure including a first projecting portion projecting from the first wall into the storage space, and a first slot located on the first end and configured to receive the first projecting portion.

The first slot includes a first slot section extending between the first surface and the second surface and a second slot section in communication with the first slot section and extending in a front-back direction, the first slot section has an inlet opening to the first surface and/or the second surface, and the first projecting portion is adapted to enter the first slot section through the inlet and then enter the second slot section.

On one hand, an assembly operation of the partition plate of the present invention is convenient and easy. On the other hand, the first projecting portion may be clamped tight in the second slot section, and movement in two directions from the first surface to the second surface can be limited, so as to effectively keep fixation of the partition plate. Furthermore, the first slot section has the inlet opening to the first surface and/or the second surface, and the partition plate may be first placed into the first space or the second space, and then moved from the first space/second space to a position matching the first projecting portion of the first slot. Therefore, whether or not a middle partition beam connected to a front end of the partition plate has been installed at the front opening of the storage space, the partition plate can be conveniently placed at a correct position. For example, during assembly, the partition plate may be placed into the first space or the second space, and then the inlet of the first end of the partition plate is aligned with the first projecting portion. After the first projecting portion enters the first slot section through the inlet, the partition plate is manipulated to move along a front-back direction, so that the first projecting portion slides into the second slot section from the first slot section. In this way, the partition plate may be positioned by using the first connecting structure.

It should be understood that, in an embodiment of the present invention, the partition plate may partition the storage space into the first space and the second space side by side. In another embodiment of the present invention, the partition plate may partition the storage space into the first space and the second space that are vertically distributed.

In an embodiment of the present invention, the first space and the second space may be thermally insulated, and in this case, a thermal insulation material may be disposed in the partition plate. In another embodiment of the present invention, a thermal insulation material is not disposed in the partition plate, and therefore the first space and the second space may perform heat exchange and have the same or similar temperatures.

Optionally, the household appliance further includes a second connecting structure configured to connect at least one of the second wall and the rear wall with the partition plate. The second connecting structure includes a second projecting portion projecting from the second wall and/or the rear wall and a second slot located on the second end. The second slot has an inlet opening to a rear end face of the partition plate, and the second projecting portion enters the second slot through the inlet of the rear end face.

During assembly, the partition plate is manipulated to tilt. The first projecting portion is aligned with the corresponding inlet in a tilted manner. Next, the partition plate is supported to be upright. The first projecting portion enters the first slot section from the inlet, and the second projecting portion is aligned with the corresponding inlet along a depth direction (that is, the front-back direction) of the storage space. Subsequently, the partition plate is pushed towards the rear wall. The first projecting portion enters the second slot section, and the second projecting portion slides into the second slot. The partition plate is assembled at the correct position.

During assembly, the second connecting structure does not need an external connecting piece, and operation is convenient and costs are low. The first connecting structure matches the second connecting structure in the depth direction of the storage space, so as to prominently increase stability of the partition plate.

Optionally, the first projecting portion is closer to the front opening than the second projecting portion in the depth direction of the storage space. In this way, from the beginning of assembly, the second projecting portion does not abut against the second end of the partition plate. The partition plate may tilt to ensure successful assembly.

Optionally, the household appliance further includes a third connecting structure configured to connect the partition plate and the rear wall, the third connecting structure including a third slot recessed from the rear wall and a third projecting portion located on the rear end face of the partition plate. The third projecting portion is located in the third slot.

Optionally, one of the first wall and the second wall is a top wall of the storage space and the other is a bottom wall of the storage space. In this way, the storage space is partitioned into the first space on the left and the second space on the right by the partition plate in a horizontal direction. The first projecting portion is limited in the second slot section in left and right directions, so as to effectively prevent the partition plate from waggling or moving in the left and right directions.

Optionally, at least two opposite clamp portions are disposed outside the second slot section and opposite to each other in a direction along which the first surface is spaced apart from the second surface, and the first projecting portion is clamped between the clamp portions. The clamp portions are formed outside the second slot section to clamp the first projecting portion, so as to further prevent the partition plate from waggling, and increase the stability of the partition plate.

Optionally, compared to the inlet of the first surface and/or the second surface, the clamp portions are farther away from the rear wall of the storage space. It can be expected that, during assembly, when the first projecting portion enters the first slot section, the partition plate is pushed towards the rear wall, and the first projecting portion slides into the second slot section. After the partition plate is pushed towards the rear wall, the partition plate may be adhered to the rear wall to avoid a gap between the partition plate and the rear wall.

Optionally, at least two first connecting structures, all of which are distributed in the front-back direction, are included.

Optionally, the household appliance is a refrigeration appliance.

Optionally, the refrigeration appliance is a refrigerator.

Other features which are considered as characteristic for the invention are set forth in the appended claims.

Although the invention is illustrated and described herein as embodied in a household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
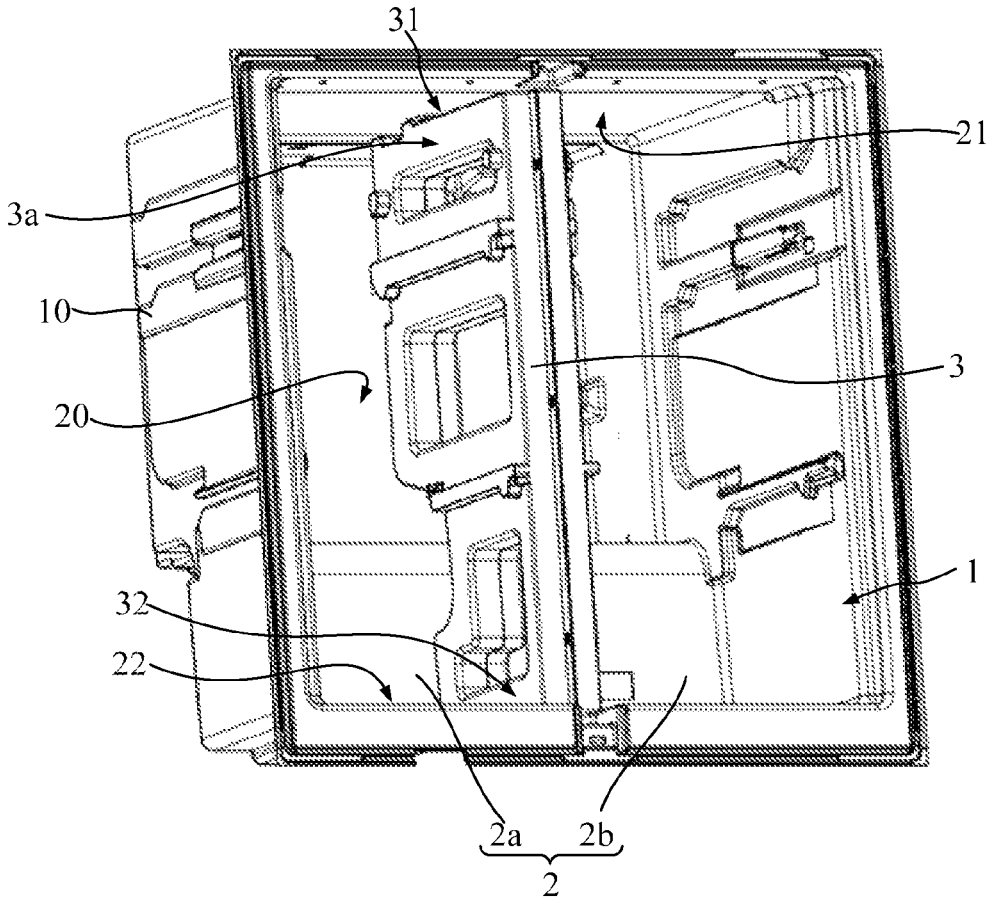
FIG. 1 is a diagrammatic, perspective view of a refrigeration appliance according to a specific embodiment of the present invention, in which only a part of the refrigeration appliance is shown.
Figure 2:
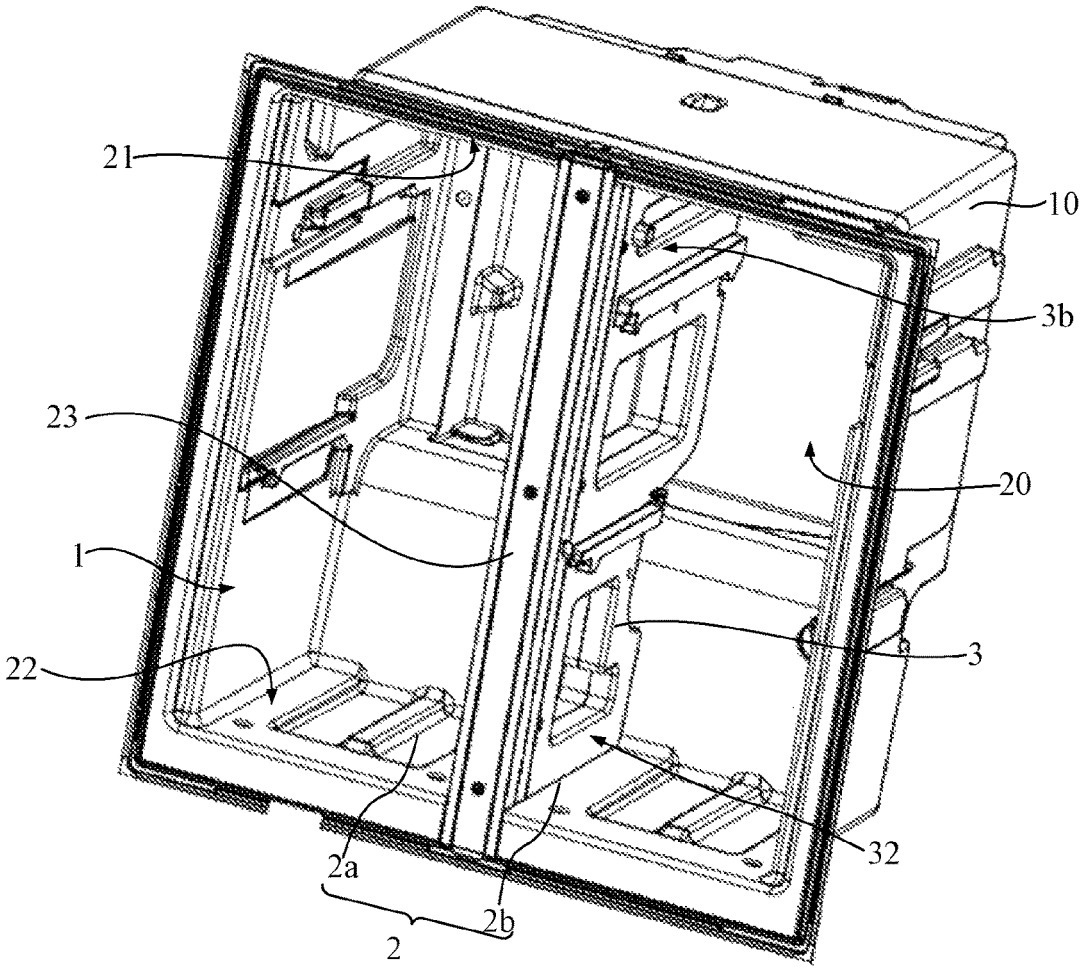
FIG. 2 is a perspective view of a refrigeration appliance according to a specific embodiment of the present invention, in which a middle beam has been removed.

Referring now to the figures of the drawings in detail and first, particularly, to FIGS. 1 and 2 thereof, there is seen a refrigeration appliance including a storage space 2 having a front opening 1, in which only a partial construction of the refrigeration appliance related to the present invention is illustrated, for example the refrigeration appliance includes a liner 10 to define the storage space. The refrigeration appliance may be a refrigerator or a wine cabinet. A rod-shaped beam 23 is disposed in front of the storage space 2.

Figure 3:
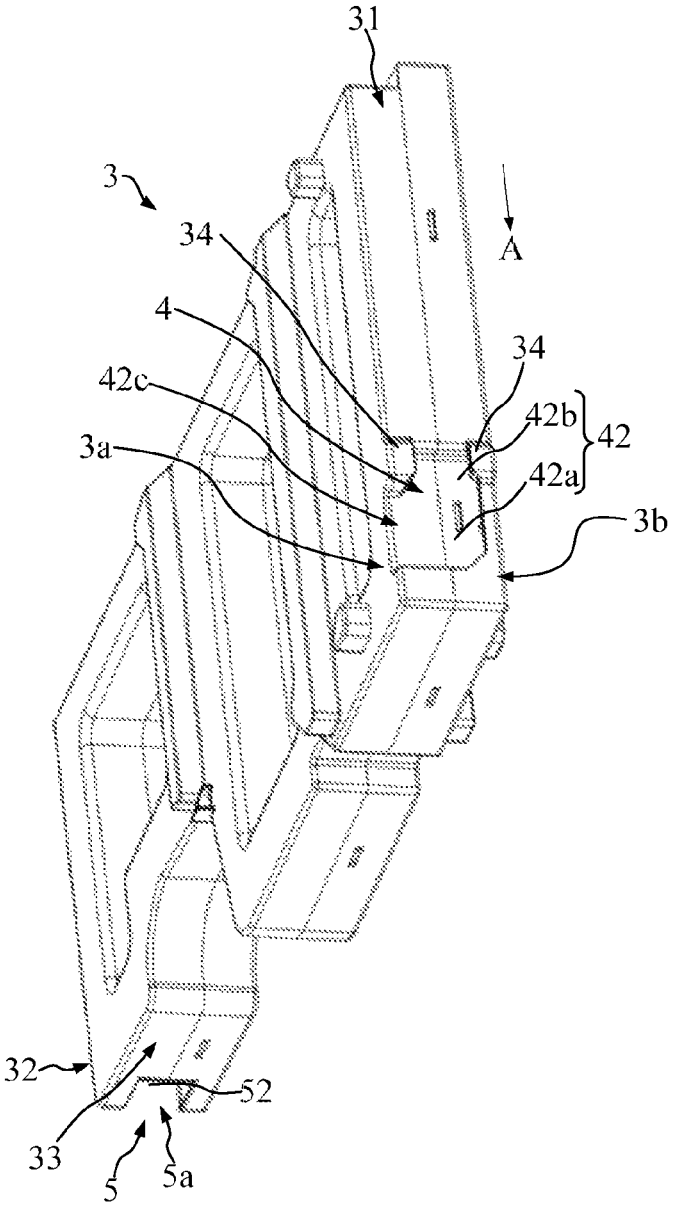
FIG. 3 is a perspective view of a partition plate in the refrigeration appliance shown in FIG. 1.

The storage space 2 has a rear wall 20, a first wall 21 and a second wall 22 disposed opposite each other, and a partition plate 3 located in the storage space 2 in order to partition the storage space 2 at least into a first space 2*a* and a second space 2*b*. With reference to FIG. 3, the partition plate 3 includes a first surface 3*a* facing the first space 2*a*, a second surface 3*b* facing the second space 2*b*, a first end 31 facing the first wall 21 and a second end 32 facing the second wall 22.

Figure 4:
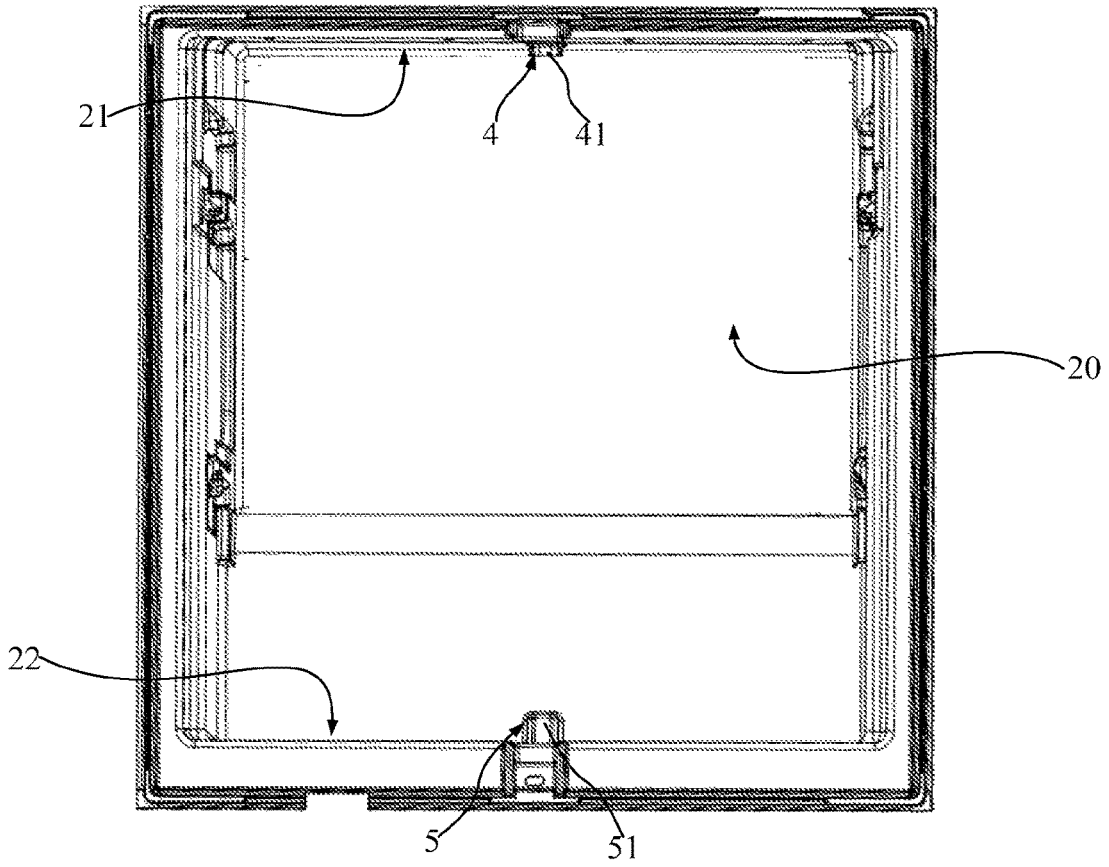
FIG. 4 is a front-elevational view of the refrigeration appliance shown in FIG. 2 in which a partition plate is not installed on the refrigeration appliance.

With reference to FIG. 3 and FIG. 4, the household appliance further includes a first connecting structure 4 configured to connect the partition plate 3 and the first wall 21. The first connecting structure 4 may include a first projecting portion 41 projecting from the first wall 21 into the storage space 2, and a first slot 42 located on the first end 31 and configured to receive the first projecting portion 41.

The first slot 42 may include a first slot section 42*a* extending between the first surface 3*a* and the second surface 3*b* and a second slot section 42*b* in communication with the first slot section 42*a* and extending in a front-back direction A of the storage space 2. The first slot section 42*a* has an inlet (referred to as a first inlet 42*c* below) opened to the first surface 3*a*. The first projecting portion 41 is adapted to enter the first slot section 42*a* through the first inlet 42*c* and then enter the second slot section 42*b*.

On one hand, an assembly structure of the partition plate of the present invention is simple, and the partition plate does not need to be fixed in the storage space 2 by using an external connecting piece, so that an assembly operation is convenient and easy. On the other hand, an opening of the second slot section 42*b* is not formed on the first surface 3*a* and the second surface 3*b*. The first projecting portion 41 may be clamped tight in the second slot section 42*b*, and movement in two directions from the first surface 3*a* to the second surface 3*b* can be limited, so as to effectively avoid fixation of the partition plate 3.

Furthermore, the first slot section 42*a* has the first inlet 42*c* opened to the first surface 3*a* and/or the second surface 3*b*, and the partition plate 3 may be first placed into the first space 2*a* or the second space 2*b*, and then moved from the first space 2*a*/second space 2*b* to a position matching the first projecting portion 41 of the first slot 42. Therefore, whether or not the beam 23 connected to a front end of the partition plate 3 has been installed at the front opening 1 of the storage space 2, the partition plate 3 can be conveniently placed at a correct position. For example, during assembly, the partition plate 3 may be placed into the first space 2*a* or the second space 2*b*, and then the first inlet 42*c* of the first end 31 of the partition plate 3 is aligned with the first projecting portion 41. After the first projecting portion 41 enters the first slot section 42*a* through the first inlet 42*c*, the partition plate 3 is operated to move along a front-back direction, so that the first projecting portion 41 slides into the second slot section 42*b* from the first slot section 42*a*. In this way, the partition plate 3 may be positioned by using the first connecting structure 4.

It should be understood that in the embodiment shown in the drawings, the partition plate 3 partitions the storage space 2 into the first space 2*a* and the second space 2*b* side by side. In another embodiment of the present invention, the partition plate may partition the storage space into a first space and a second space that are vertically distributed, and in this embodiment, the partition plate may be horizontally disposed.

In an embodiment of the present invention, the first space 2*a* and the second space 2*b* may be thermally insulated, and in this case, a thermal insulation material may be disposed in the partition plate 3. In another embodiment of the present invention, a thermal insulation material may not be disposed in the partition plate 3, and therefore the first space 2*a* and the second space 2*b* may perform heat exchange and have the same or similar temperatures.

Figure 5:
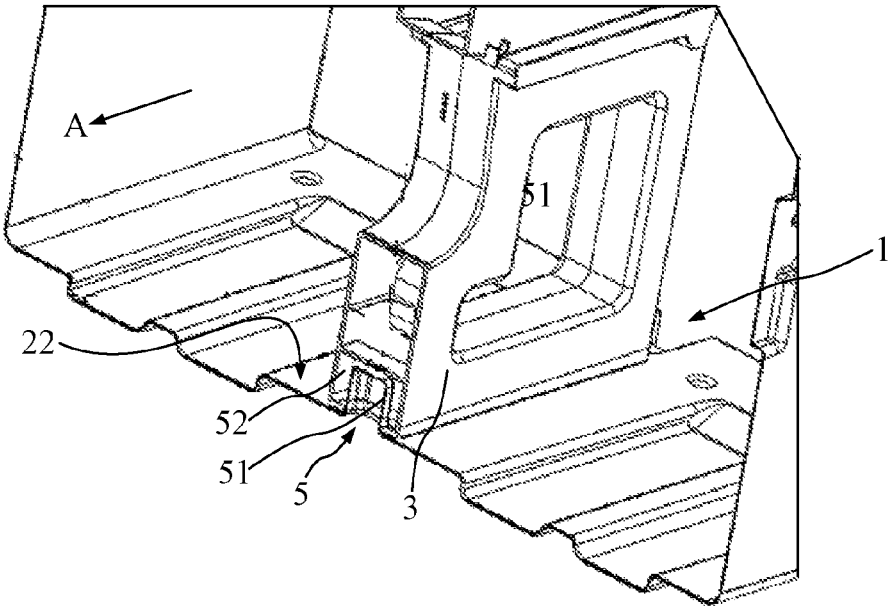
FIG. 5 is a fragmentary, perspective view obtained by viewing a refrigeration appliance according to a specific embodiment of the present invention from back to a front opening, showing a second connecting structure that connects a partition plate and a second wall of a storage space.

Referring to FIG. 3 to FIG. 5 in cooperation with FIG. 2, the household appliance further includes a second connecting structure 5 configured to connect the partition plate 3 and the second wall 22. The second connecting structure 5 includes a second projecting portion 51 projecting from the second wall 22 and a second slot 52 located on the second end 32 of the partition plate 3. The second slot 52 has an inlet (referred to as a second inlet 5*a* below) opened to a rear end face 33 of the partition plate 3. The second projecting portion 51 enters the second slot 52 through the second inlet 5*a* of the rear end face 33.

During assembly, the partition plate 3 is operated by tilting in that the first inlet 42*c* is aligned with the first projecting portion 41 in a tilted manner; next the partition plate 3 is supported to be upright, the first projecting portion 41 enters the first slot section 42*a* from the first inlet 42*c*, and the second inlet 5*a* is aligned with the second projecting portion 51 along a depth direction (that is, the front-back direction A) of the storage space 2. Subsequently, the partition plate 3 is pushed towards the rear wall 20. The first projecting portion 41 enters the second slot section 42*b*, and the second projecting portion 51 slides into the second slot 52, so that the partition plate 3 is assembled in the correct position.

During assembly, the second connecting structure 5 does not need an external connecting piece, and operation is convenient. The first connecting structure 4 matches the second connecting structure 5 in the depth direction of the storage space, so as to prominently increase stability of the partition plate 3.

As seen in the depth direction of the storage space 2, the first projecting portion 41 is closer to the front opening 1 than the second projecting portion 51. In this way, from the beginning of assembly, the second projecting portion 51 does not abut against the second end 32 of the partition plate 3. The partition plate 3 may tilt to ensure successful assembly.

As an improvement, the second connecting structure may be disposed on the rear wall of the storage space. The second connecting structure includes the second projecting portion projecting from the rear wall and the second slot located on the second end of the partition plate. Therefore, the household appliance may include the second connecting structure configured to connect at least one of the second wall and the rear wall with the partition plate.

As another improvement, the household appliance may include a third connecting structure configured to connect the partition plate and the rear wall of the storage space. The third connecting structure includes a third slot recessed from the rear wall and a third projecting portion located on the rear end face of the partition plate. The third projecting portion is located in the third slot. The first connecting structure, the second connecting structure, and the third connecting structure function together, so as to further prominently increase installation stability and fastness of the partition plate.

In addition to placing the first inlet 42*c* on the first surface 3*a*, an inlet may also be disposed on the second surface. Therefore, the first slot section may have an inlet opened to the first surface and/or the second surface.

The first wall 21 may be a top wall. The second wall 22 may be a bottom wall. In this way, the storage space 2 is partitioned into the first space 2*a* on the left and the second space 2*b* on the right by the partition plate 3 in a horizontal direction. The first projecting portion 41 is limited in the second slot section 42*b* in left and right directions, so as to effectively prevent the partition plate 3 from waggling in the left and right directions. In this case, from the beginning of assembly, the partition plate 3 needs to tilt in a vertical direction, and subsequent assembly steps are performed thereafter.

It should be understood that in an embodiment in which the partition plate is horizontally disposed, the first wall and the second wall may be disposed opposite each other along a horizontal direction, for example the first wall and the second wall may be respective left and right side walls.

At least two clamp portions 34 are disposed outside the second slot section 42*b* and opposite to each other in a direction along which the first surface 3*a* is spaced apart from the second surface 3*b*, and the first projecting portion 41 is clamped between the clamp portions 34. The clamp portions 34 are formed outside the second slot section 42*b* to clamp the first projecting portion 41, so as to further prevent the partition plate 3 from waggling, and increase the stability of the partition plate 3.

As compared to the first inlet 42*c* of the first surface 3*a*, the clamp portions 34 are farther away from the rear wall 20 of the storage space 2. During assembly, when the first projecting portion 41 enters the first slot section 42*a*, the partition plate 3 is pushed towards the rear wall 20, and the first projecting portion 41 slides into the second slot section 42*b*. It can be expected that after the partition plate 3 is pushed towards the rear wall 20, the partition plate 3 may be adhered to the rear wall 20 to avoid a gap between the partition plate 3 and the rear wall 20.

After the partition plate 3 is positioned in the storage space, the front end of the partition plate 3 may be fixed on the beam 23 by using a fixing apparatus, such as a bolt. In this way, the partition plate 3 is stably fixed in the storage space.

The household appliance may be provided with a first connecting structure 4. As an improved configuration, the household appliance may be provided with at least two first connecting structures, which are distributed in the front-back direction A of the household appliance, so as to increase stability of the partition plate.

Although the present invention is disclosed as above, the present invention is not limited thereto. Any person ordinarily skilled in the art can make various variations and modifications without departing from the spirit and scope of the present invention, and therefore the scope of protection of the present invention is subject to the appended claims.

The invention claimed is:

1. A household appliance, comprising:

a storage space having first and second mutually opposite walls and a front opening and a rear wall defining a front-back direction;

a partition plate located in said storage space and partitioning said storage space into at least a first space and a second space, said partition plate including a first surface facing said first space, a second surface facing said second space, a first end facing said first wall and a second end facing said second wall;

a first connecting structure configured to interconnect said partition plate and said first wall, said first connecting structure including a first projecting portion projecting from said first wall into said storage space, and a first slot located on said first end and configured to receive said first projecting portion;

said first slot including a first slot section extending between said first surface and said second surface and a second slot section communicating with said first slot section and extending in said front-back direction, said first slot section having an inlet opening to at least one of said first surface or said second surface; and said first projecting portion being adapted to enter said first slot section through said inlet and to then enter said second slot section.

2. The household appliance according to claim 1, which further comprises:

a second connecting structure configured to connect at least one of said second wall or said rear wall to said partition plate;

said second connecting structure including a second projecting portion projecting from at least one of said second wall or said rear wall and a second slot located on said end;

said partition plate having a rear end face;

said second slot having an inlet opening to said rear end face of said partition plate; and said second projecting portion entering said second slot through said inlet of said rear end face.

3. The household appliance according to claim 2, wherein said storage space has a depth direction, and said first projecting portion is closer to said front opening than said second projecting portion, in said depth direction.

4. The household appliance according to claim 1, which further comprises a third connecting structure configured to interconnect said partition plate and said rear wall, said third connecting structure including a third slot recessed from said rear wall and a third projecting portion located on said rear end face of said partition plate, said third projecting portion being located in said third slot.

5. The household appliance according to claim 1, wherein one of said first and second walls is a top wall of said storage space and the other of said first and second walls is a bottom wall of said storage space.

6. The household appliance according to claim 1, wherein:

said first surface is spaced apart from said second surface in a spacing direction;

at least two clamp portions are disposed outside said second slot section and are disposed opposite to each other in said spacing direction; and said first projecting portion is clamped between said clamp portions.

7. The household appliance according to claim 6, wherein said clamp portions are farther away from said rear wall of said storage space than said inlet of at least one of said first surface or said second surface.

8. The household appliance according to claim 1, which further comprises at least a second connecting structure, said connecting structures all being distributed in said front-back direction.

9. The household appliance according to claim 1, wherein the household appliance is a refrigeration appliance.

10. The household appliance according to claim 9, wherein the refrigeration appliance is a refrigerator.

* * * * *